US007685959B1

(12) United States Patent
Sanders

(10) Patent No.: US 7,685,959 B1
(45) Date of Patent: Mar. 30, 2010

(54) SURFBOARD WITH GRADUATED CHANNELS

(76) Inventor: Roy F. Sanders, 6321 Carrington Dr., Austin, TX (US) 78749

( * ) Notice: Subject to any disclaimer, the term of this patent is extended or adjusted under 35 U.S.C. 154(b) by 30 days.

(21) Appl. No.: 12/059,534

(22) Filed: Mar. 31, 2008

Related U.S. Application Data

(63) Continuation-in-part of application No. PCT/US2007/078019, filed on Sep. 10, 2007, which is a continuation-in-part of application No. 11/518,572, filed on Sep. 8, 2006, now Pat. No. 7,275,490, and a continuation-in-part of application No. 11/517,679, filed on Sep. 8, 2006, now Pat. No. 7,281,488, and a continuation-in-part of application No. 11/518,457, filed on Sep. 8, 2006, now abandoned, said application No. 11/518,572 is a continuation-in-part of application No. 11/139,939, filed on May 27, 2005, now Pat. No. 7,111,569, said application No. 11/517,679 is a continuation-in-part of application No. 11/139,939.

(51) Int. Cl.
*B63B 1/32* (2006.01)

(52) U.S. Cl. ..... 114/288; 441/65; 441/74; 441/79

(58) Field of Classification Search ..... 114/61.2, 114/61.21, 288, 290; 441/44, 45, 65, 74, 441/79
See application file for complete search history.

(56) References Cited

U.S. PATENT DOCUMENTS

| | | | | |
|---|---|---|---|---|
| 3,201,807 | A * | 8/1965 | Weaver | 441/79 |
| 3,323,154 | A * | 6/1967 | Lambach | 441/74 |
| 4,439,166 | A * | 3/1984 | Maxwell | 441/79 |
| 5,342,231 | A * | 8/1994 | Henns | 441/79 |
| 5,503,581 | A * | 4/1996 | McCullough | 441/79 |
| 6,551,157 | B1 * | 4/2003 | Bishop | 441/65 |
| 6,878,025 | B2 * | 4/2005 | Mead | 441/74 |
| 7,025,645 | B1 * | 4/2006 | Hsieh | 441/79 |

* cited by examiner

*Primary Examiner*—Lars A Olson
(74) *Attorney, Agent, or Firm*—Buskop Law Group, PC; Wendy Buskop

(57) ABSTRACT

A surfboard having at least one fin, which an be removably connected to the underside proximate to the board tail end. First and second graduated channels are disposed in the underside, each having a front end shallower than a tail end, wherein the front ends are proximate to the board midsection and the tail ends are proximate to the board tail end, and wherein the graduated channels are substantially parallel to the central axis of the surfboard. A keel is disposed in the underside along the central axis, centered between the first and second graduated channels.

14 Claims, 6 Drawing Sheets

SURFBOARD WITH GRADUATED CHANNELS

CROSS REFERENCE TO RELATED APPLICATIONS

The present patent application is a continuation-in-part application which claims the benefit under 35 USC §365(c) of the PCT Application having the International Application Number PCT/US07/07819, filed Sep. 10, 2007, which claims priority to the US Patent Application having the Ser. No. 11/518,572, filed Sep. 8, 2006, now U.S. Pat. No. 7,275,490, the US Patent Application having the Ser. No. 11/517,679, filed Sep. 8, 2006, now U.S. Pat. No. 7,281,488, and the US Patent Application having the Ser. No. 11/518,457, filed Sep. 8, 2006. US Patent Application having the Ser. No. 11/518, 572, and US Patent Application having the Ser. No. 11/517, 679, both filed Sep. 8, 2006 claim priority to the US Patent Application having the Ser. No. 11/139,939, filed on May 27, 2005, now U.S. Pat. No. 7,111,569, the entirety of which are incorporated herein by reference.

FIELD

The present embodiments relate to a surfboard having graduated channels and at least one fin for providing improved stability and control.

BACKGROUND

A need exists for a surfboard that provides enhanced stability over existing surfboards, and that provides fast turning ability for executing tricks.

A need also exists for a surfboard that facilitates travel in a straight line without veering.

A further need exists for a surfboard having removable fins, enabling variable fin configurations to be used to match water conditions or a selected style of surfing.

The present embodiments meet these needs.

BRIEF DESCRIPTION OF THE DRAWINGS

The detailed description will be better understood in conjunction with the accompanying drawings as follows.

Figure 1:
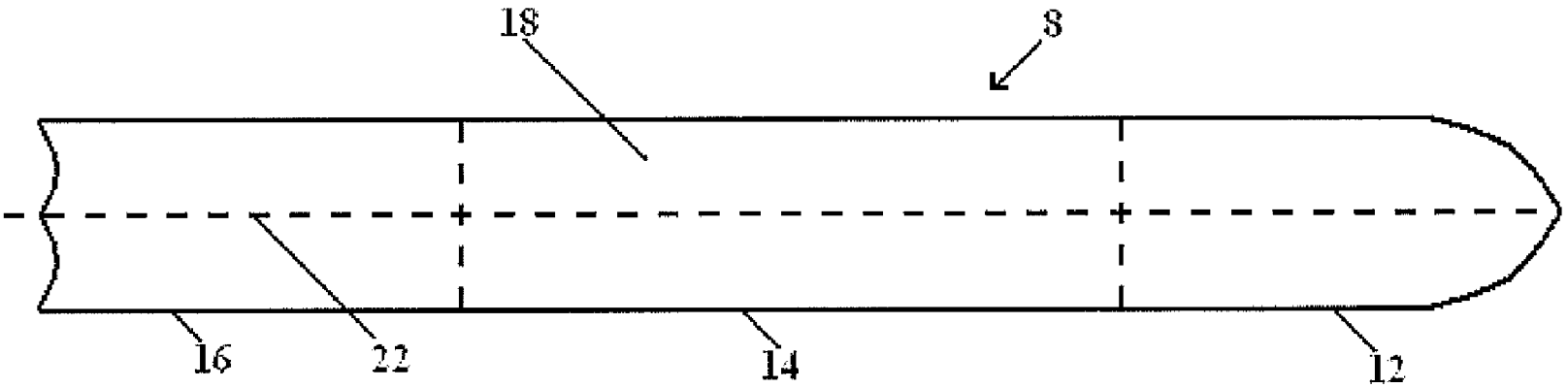
FIG. 1 depicts a top view of an embodiment of the present surfboard.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a surfboard that provides enhanced stability over existing surfboards, other floatation devices and watercraft through use of two generally parallel graduated channels disposed in the underside of the surfboard, that are parallel to the central axis of the surfboard. The graduated channels allow the surfboard to remain stable more easily, without tipping, when one or more persons stand on the surfboard.

The graduated channels are contemplated to compress water beneath the surfboard into a more confined space. The compressed water acts as a rudder to provide directional stability. The compressed water travels at a different speed from the water adjacent the surfboard, facilitating the forward motion of the surfboard in a straight line. Conventional surfboards, flotation devices, and other watercraft can veer off a straight course by at least 10 degrees. This enhanced control feature can make the present surfboard seam "rocket" powered.

The improved stability of the present surfboard allows the surfboard to remain highly stable in a draft of water only a few inches deep, such as three inches or less, which can allow inexperienced users to practice balance and technique, even in waves having short height or relatively calm surf. The ability of the present surfboard to float in shallow water also provides increased safety by allowing surfers to ride the surfboard closer to shore without the board contacting the bottom of the body of water and causing the surfer to fall, and without requiring the surfer to dismount in deeper water, which sharks can inhabit.

The present surfboard also provides the advantage of removable fins, which can be removed and reattached to facilitate storage, shipping, and travel. Additionally, the removable fins can be removed and attached in varying configurations, enabling the present surfboard to be configured to perform well in selected water conditions, or to match a certain surfing style. For example, an expert user can attach fins to form a tri-fin configuration, useable to enable two fins to simultaneously create torque in a body of water, causing the fins to flex and then release, accelerating the surfboard. A less experienced user can then create a four-fin trapezoidal configuration to promote stability.

It is further contemplated that different types of fins, having differing shapes, such as curved triangular shapes, straight triangular shapes, diamond shapes, trapezoidal shapes, rounded shapes, and other similar shapes, or fins having differing thicknesses, and/or compositions can be used to provide different features relating to the control and stability of the surfboard.

The present surfboard includes a generally flat, floatable board, which can be made from fiberglass, high density plastic, expanded polystyrene, or similar floatable materials.

The surfboard can have a coating for resisting wear, corrosion due to moisture and marine conditions, and damage caused by impact, as well as for decorative or aesthetic purposes. Coatings can include paint, polymers, rubber, wax, or similar coatings.

The surfboard has a board front, a board midsection adjacent the board front, and a board tail end adjacent the board midsection. The surfboard also has a top side, an underside, and a central axis. The underside has an underside right portion and an underside left portion.

In an embodiment, the surfboard can have a length ranging from about 3 feet to about 10 feet, a width ranging from about 6 inches to about 18 inches, and a thickness ranging from about 1 inch to about 8 inches.

The surfboard is contemplated to be solid, however in an embodiment, the surfboard can be generally hollow, having one or more baffles formed interior of the generally flat, floatable board between the top side and the underside. The baffles can be solid, such as partition walls, or the baffles can be perforated, or otherwise configured to allow selective transfer of internal liquid or gas between interior portions of the generally flat, floatable board.

In an embodiment, the generally flat, floatable board can be inflatable.

At least one fin is removably connected to the underside of the generally flat, floatable board, proximate to the board tail end. The present surfboard can accommodate any number of fins, such as from two to four fins. The present surfboard can further accommodate any fin configuration. For example, three or four removable fins can be connected to the underside of the generally flat, floatable board in an offset, diamond-shaped pattern. Other fin configurations, such as single-fin or tri-fin patterns are also contemplated.

Each fin is contemplated to have a curved triangular shape. Each fin can range from about 2 inches to about 12 inches in length, from about ⅛ inches in width, and from about 1 inch to about 4 inches in thickness. The curvature of each fin can range from about 1 degree to about 100 degrees or more. Each fin can also have a different shape, such as a straight triangular shape, a rounded shape, or another shape.

It is contemplated that the surfboard can have multiple fins having identical dimensions and shapes, or multiple fins having differing shapes. For example, four fins can be attached to the underside of the generally flat, floatable board in a "V" shape, wherein the two fins closest to the board front can have a length of about 3 inches, while the two fins closes to the board tail end have a length of about 5 inches.

The fins can be made from similar materials to the generally flat, floatable board. The fins can be solid, however it is contemplated that the fins can also be at least partially hollow, to reduce the overall weight of the surfboard and to modify the effect that waves and current have on the motion of the surfboard.

In an embodiment, one or more of the fins can be perforated, which can reduce the weight of the fins and surfboard, can reduce the cost of the surfboard, and can reduce the material consumed in construction of the fins. Perforations in the fins also provide the benefit of reducing the effect of waves and currents perpendicular to the surfboard that impact the fins, by allowing water to flow through the perforations.

It is contemplated that the fins can be removably attached to the generally flat, floatable board using slots adapted to secure a connecting portion of the fins, fasteners such as screws or bolts, other similar means, or combinations thereof.

A first graduated channel is disposed in the underside of the generally flat, floatable board, parallel to the central axis of the generally flat, floatable board. The first graduated channel has a first front end shallower than a first tail end. The first front end is proximate to the board midsection, and the first tail end is proximate to the board tail end.

A second graduated channel can also be disposed in the underside of the generally flat, floatable board, parallel to the central axis of the generally flat, floatable board. The second graduated channel has a second front end shallower than a second tail end. The second front end is proximate to the board midsection, and second first tail end is proximate to the board tail end.

It is contemplated that the first graduated channel and the second graduated channel are each disposed in the underside an equal distance from the central axis of the generally flat, floatable board.

Each graduated channel can have a length ranging from about 30 percent to about 60 percent of the length of the underside, a width ranging from about 1 inch to about 3 inches at the board tail end that tapers toward the board midsection, and a graduation ranging from about 1 degree near the board midsection to about 4 degrees at the board tail end.

For example, each graduated channel can be about 4 inches wide and about 0.75 inches deep at the board tail end, and taper to about 0.5 inches wide and about 0.25 inches deep at the board midsection.

The graduated channels can be generally "V" shaped, "U" shaped, or have another similar shape that becomes both narrower and more shallow near the board midsection, and wider and deeper near the board tail end.

A keel can be disposed in the underside of the generally flat, floatable board, along the central axis, centered between the first graduated channel and the second graduated channel.

In an embodiment, the keel is contemplated to range in height from about 0.25 inches to about 1 inch. The keel can have a rounded edge that extends no more than about 1 inch above the underside of the surfboard.

It is contemplated that the board tail end can have a variety of shapes adapted for surfing in various water conditions or for facilitating a selected surfing style. In an embodiment, the board tail end can have a plane face. It is also contemplated that the board tail end can be shaped as a rounded end.

The board tail end can also have a "swallow tail," which is contemplated to be a "W" shape, a "round tail," which is contemplated to be a "U" shape, a "pin tail," which is contemplated to be a "V" shape, a "bat wing," which is contemplated to have a shape to accommodate two adjacent arches, a "squash tail", which is contemplated to have a trapezoidal shape that narrows toward the board tail end, or a "double wing swallow tail," which is contemplated to have the shape of two angled edges that terminate in a "W" shape. Other similar board tail shapes are also contemplated.

In an embodiment, the board front can rise from about 3 degrees to about 8 degrees from the central axis, to create a raised board front. A graduated "V" can be formed in the raised board front. It is contemplated that the raised board front and graduated "V" shape can increase the stability of the surfboard in turbulent water conditions by facilitating the flow of water beneath the surfboard.

Referring now to FIG. 1, a top view of an embodiment of the present surfboard is depicted.

The depicted surfboard (8) is shown as a generally flat, floatable board. It is contemplated that the depicted surfboard can be made from solid fiberglass, and is about 8 feet in length, about 18 inches in width, and about 1 inch in thickness. The surfboard (8) can also be made from a polymer alloy of carbon graphite and polypropylene or polyethylene, other similar materials, or combinations thereof.

The surfboard (8) is shown having a top side (18), which is contemplated to be substantially smooth and flat.

The surfboard (8) has a central axis (22), which bisects the surfboard (8) longitudinally. The surfboard (8) is also shown having a board front (12), a board midsection (14), and a board tail end (16).

The board front (12), board midsection (14), and board tail end (16) are each contemplated to have a length equal to approximately one third the length of the surfboard (8).

Figure 2:
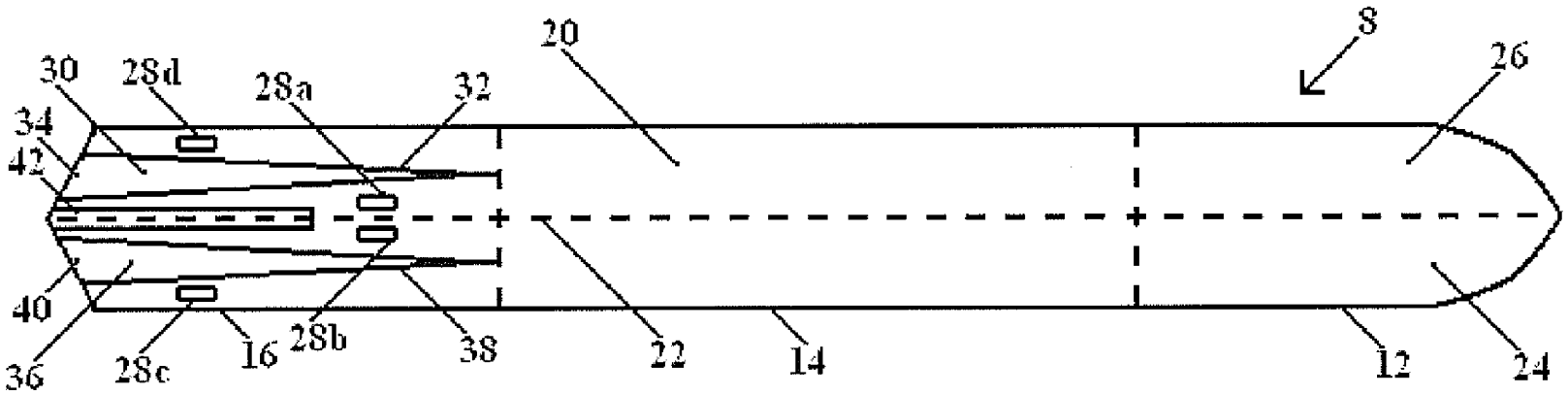
FIG. 2 depicts a bottom view of an embodiment of the present surfboard.

Referring now to FIG. 2, a bottom view of the surfboard (8) depicted in FIG. 1 is shown.

The surfboard (8) is shown having a central axis (22) and an underside (20). The surfboard (8) is also shown having a board front (12), a board midsection (14), and a board tail end (16).

The underside (20) is depicted having an underside right portion (24) and an underside left portion (26). It is contemplated that the underside right portion (24) and the underside left portion (26) are equal halves that are symmetrical about the central axis (22).

A first fin (28*a*) and a fourth fin (28*d*) are shown removably connected to the underside left portion (26) proximate to the board tail end (16). A second fin (28*b*) and a third fin (28*c*) are shown removably connected to the underside right portion (24) proximate to the board tail end (16).

While any number of fins in any configuration can be removably connected to the underside (20), FIG. 2 depicts four fins oriented in a "V" shaped configuration, with the point of the "V" shape facing the board front (12) and the prongs of the "V" shape facing the board tail end (16). The first fin (28*a*) and second fin (28*b*) are shown approximately 2 inches from the central axis (22) and about 18 inches from the tail of the surfboard (8), while the third fin (28*c*) and fourth fin (28*d*) are shown about 8 inches from the central axis (22) and about 8 inches from the tail of the surfboard (8).

A first graduated channel (30) is shown disposed in the underside left portion (26), substantially parallel to the central axis (22). The first graduated channel (30) has a first front end (32) proximate to the board midsection (14) and a first tail end (34) proximate to the board tail end (16). It is contemplated that the first graduated channel (30) is shallower at the first front end (32) than at the first tail end (34).

A second graduated channel (36) is shown disposed in the underside right portion (24), substantially parallel to the central axis (22). The second graduated channel (36) has a second front end (38) proximate to the board midsection (14) and a second tail end (40) proximate to the board tail end (16). It is contemplated that the second graduated channel (36) is shallower at the second front end (38) than at the second tail end (40).

It is contemplated that the first graduated channel (30) and the second graduated channel (36) can be identical graduated channels that are symmetrically disposed in the underside (20) about the central axis (22).

Each graduated channel is depicted approximately 1.5 inches in depth and about 2 inches in width at the board tail end (16), and each graduated channel tapers in both depth and width toward the board midsection (14), having a length of about 2 feet. The graduated channels can be deeper or shallower, and wider or narrower, depending on the length and width of the surfboard (8).

A keel (42) is shown disposed in the underside (20) along the central axis (22). The keel (42) is centered between the first graduated channel (30) and the second graduated channel (38).

The keel (42) is contemplated to be about 0.75 inches in height and has a rounded edge extending just less than one inch above the underside (22). It is contemplated that the keel (42) further improves the stability of the surfboard (8) in combination with the graduated channels and the fins.

Figure 3:
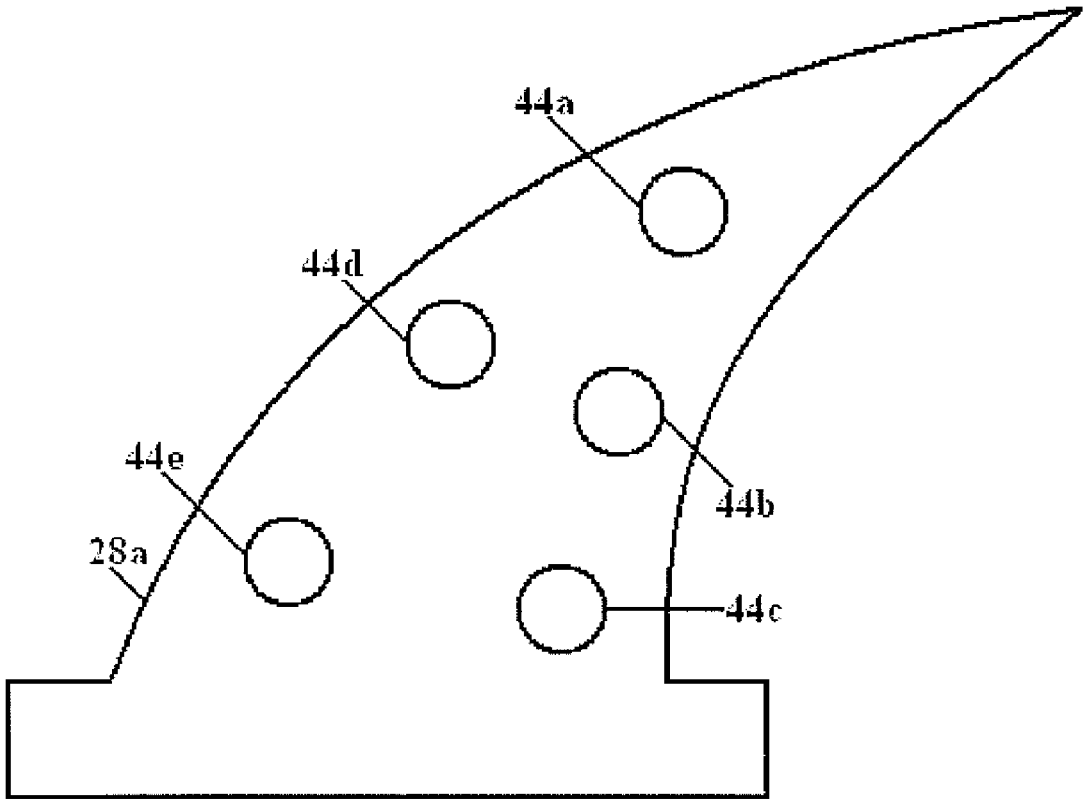
FIG. 3 depicts a side view of an embodiment of a removable fin useable with the present surfboard.

Referring now to FIG. 3, a side view of an embodiment of a perforated fin is depicted.

The first fin (28*a*) is shown having a curved triangular shape. The first fin (28*a*) has a first perforation (44*a*), a second perforation (44*b*), a third perforation (44*c*), a fourth perforation (44*d*), and a fifth perforation (44*e*). Each depicted perforation is contemplated to be a round hole having a diameter of approximately 0.25 inches.

While FIG. 3 depicts the first fin (28*a*) having five round perforations in a staggered arrangement, any of the fins can have perforations of any size or shape, in any desired arrangement. The size, shape, and arrangement of the perforations can be selected to modify the effect of waves, currents, and other lateral forces applied to the fins on the motion of the surfboard, by allowing water to flow through the perforations.

While FIG. 3 depicts the first fin (28*a*) having a curved triangular shape, the fin can be diamond shaped, trapezoidal, a triangular shape with less curvature, or another similar shape.

Figure 4:
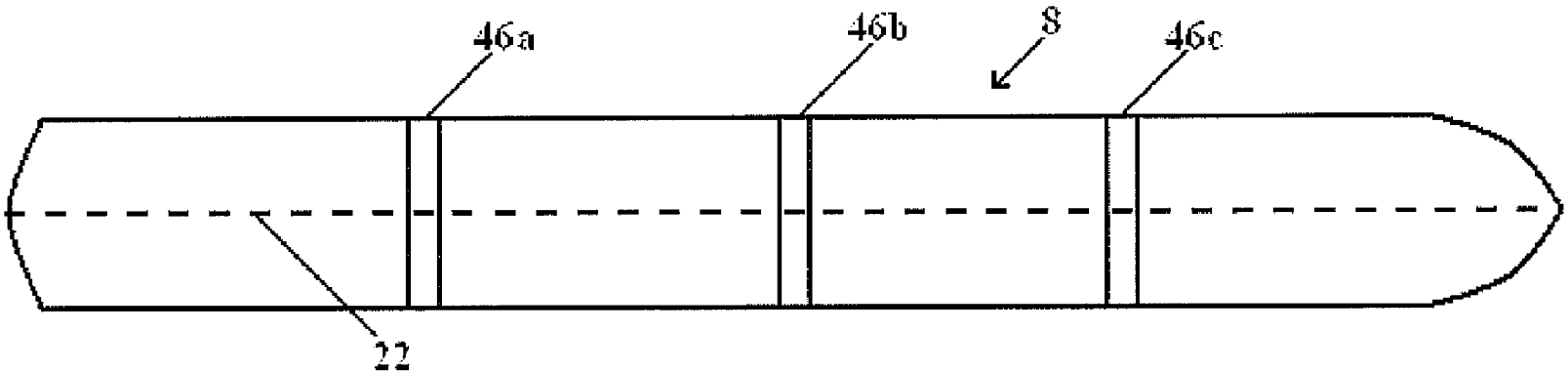
FIG. 4 depicts a top cross-sectional view of an embodiment of the present surfboard.

Referring now to FIG. 4, FIG. 4 depicts a top cross-sectional view of an embodiment of the surfboard.

FIG. 4 depicts a blow molded surfboard (8) that is hollow.

A first baffle (46*a*), a second baffle (46*b*), and a third baffle (46*c*) are depicted formed interior of the surfboard (8). The baffles can be made from fiberglass, plastic, or other similar materials. It is contemplated that the baffles can be walls that partition the interior of the surfboard (8) into sections. It is also contemplated that the baffles can be perforated, or otherwise configured to selectively or continuously allow liquid or gas to flow between interior sections of surfboard (8).

The depicted baffles have a length substantially equal to the width of the surfboard (8) and a height substantially equal to the thickness of the surfboard (8). The baffles can range in thickness from about 0.25 inches to about 2 inches.

Figure 5:
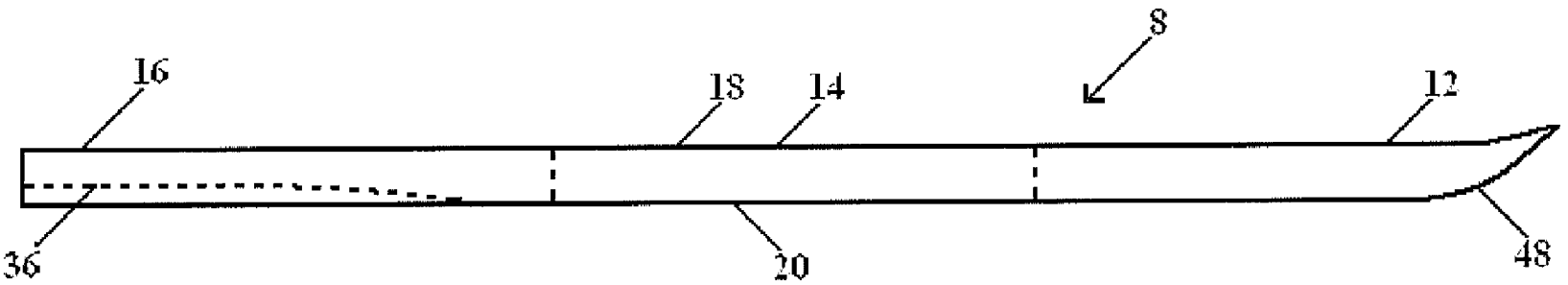
FIG. 5 depicts a side view of an embodiment of the present surfboard with a raised board front.

Referring now to FIG. 5, a side view of an embodiment of the present surfboard is shown.

The present surfboard (8) is having a top side (18) and an underside (20). The surfboard (8) also has a board front (12), a board midsection (14), and a board tail end (16).

A second graduated channel (36) is shown disposed in the board tail end (16).

FIG. 5 shows the board front (12) having a rise of approximately 6 degrees, forming a raised board front (48). The raised board front (48) is contemplated to facilitate navigation of the surfboard (8) and to improve stability against waves and currents that impart force to the board front (12).

Figure 6:
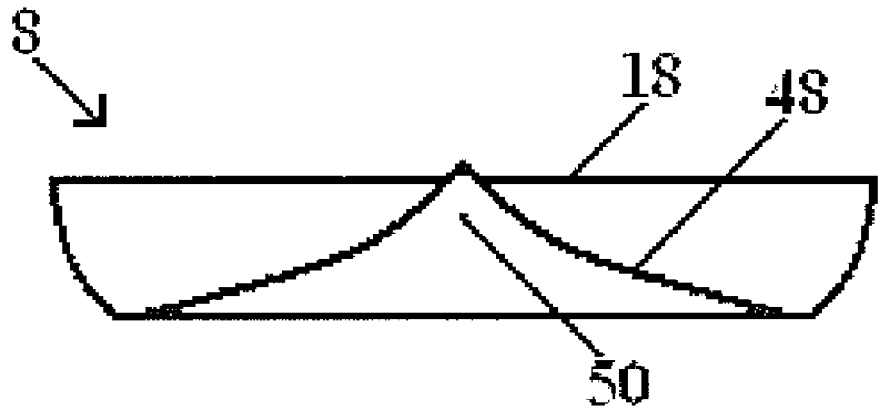
FIG. 6 depicts a front view of an embodiment of the present surfboard with a graduated "V."

Referring now to FIG. 6, a front view of an embodiment of the present surfboard is shown.

The depicted surfboard (8) is shown with a top side (18) visible in this view. The surfboard (8) has a raised board front (48), with a graduated "V" (50) formed in the raised board front (48). The graduated "V" (50) is contemplated to facilitate navigation of the surfboard (8) and to improve stability against longitudinal waves and currents that impact the front of the surfboard (8).

The graduated "V" (50) has a width equal to the width of the surfboard (8) that tapers toward the board front at a gradient ranging from about 10 degrees to about 60 degrees.

While these embodiments have been described with emphasis on the embodiments, it should be understood that within the scope of the appended claims, the embodiments might be practiced other than as specifically described herein.

What is claimed is:

1. A surfboard comprising:

a board front, a board midsection, a board tail end, a top side, an underside, and a central axis, wherein the underside comprises an underside right portion and an underside left portion;

at least one fin removably connected to the underside proximate to the board tail end;

a first graduated channel disposed in the underside left portion having a first front end shallower than a first tail end, wherein the first front end is proximate to the board midsection and the first tail end is proximate to the board tail end, and wherein the first graduated channel is substantially parallel to the central axis;

a second graduated channel disposed in the underside right portion having a second front end shallower than a second tail end, wherein the second front end is proximate to the board midsection and the second tail end is proximate to the board tail end, and wherein the second graduated channel is substantially parallel to the central axis; and a keel disposed in the underside along the central axis separating the first graduated channel and the second graduated channel.

2. The surfboard of claim 1, wherein the at least one fin removably connected to the underside comprises perforations.

3. The surfboard of claim 1, further comprising from two fins to four fins removably connected to the underside.

4. The surfboard of claim 1, further comprising from three fins to four fins connected to the underside in an offset pattern.

5. The surfboard of claim 1, wherein the board tail end has a plane face.

6. The surfboard of claim 1, wherein the board tail end is shaped as a rounded end.

7. The surfboard of claim 1, wherein the board tail end has a shape selected from the group consisting of: a swallow tail, a round tail, a pin tail, a bat wing, a squash tail, or a double wing swallow tail.

8. The surfboard of claim 1, wherein the surfboard has a length ranging from about 3 feet to about 10 feet, a width ranging from about 6 inches to about 18 inches, and a thickness ranging from about 1 inch to about 8 inches.

9. The surfboard of claim 1, wherein the surfboard is generally hollow with at least one baffle formed interior of the surfboard.

10. The surfboard of claim 1, wherein the board front rises from about 3 degrees to about 8 degrees from the central axis, creating a raised board front.

11. The surfboard of claim 10, wherein a graduated V is formed in the raised board front.

12. The surfboard of claim 1, wherein the first graduated channel and the second graduated channel have a length ranging from about 30 percent to about 60 percent of the length of the underside, a width ranging from about 1 inch to about 3 inches, and a graduation in each channel ranging from about 1 degree near the board midsection to about 4 degrees at the board tail end.

13. The surfboard of claim 1, wherein the keel has a height ranging from about 0.25 inches to about 1 inch.

14. The surfboard of claim 13, wherein the keel has a rounded edge that extends no more than about 1 inch above the underside.

* * * * *